US006271501B1

(12) United States Patent
Morgan

(10) Patent No.: US 6,271,501 B1
(45) Date of Patent: Aug. 7, 2001

(54) HIGH TEMPERATURE ROTATING VACUUM KILN AND METHOD FOR HEAT TREATING SOLID PARTICULATE MATERIAL UNDER A VACUUM

(75) Inventor: Allan C. Morgan, Manchester, MA (US)

(73) Assignee: Cabot Corporation, Boston, MA (US)

( * ) Notice: Subject to any disclaimer, the term of this patent is extended or adjusted under 35 U.S.C. 154(b) by 0 days.

(21) Appl. No.: 09/611,828

(22) Filed: Jul. 7, 2000

Related U.S. Application Data

(62) Division of application No. 09/100,970, filed on Jun. 22, 1998, now Pat. No. 6,105,272.

(51) Int. Cl.[7] ..... F27B 7/00

(52) U.S. Cl. ..... 219/389; 219/388; 110/203; 110/216; 34/63

(58) Field of Search ..... 219/388, 389, 219/390; 432/112, 106; 201/4; 110/203, 216; 422/287, 288; 75/401, 419, 670; 34/63, 92, 134

(56) References Cited

U.S. PATENT DOCUMENTS

| | | | | |
|---|---|---|---|---|
| 2,507,123 | | 5/1950 | Sproule et al. | 23/279 |
| 3,039,753 | | 6/1962 | Eketorp et al. | 263/33 |
| 3,619,908 | | 11/1971 | Kallas | 34/56 |
| 3,794,462 | | 2/1974 | Sylvest | 432/80 |
| 3,802,847 | * | 4/1974 | Hara et al. | 23/279 |
| 3,809,528 | | 5/1974 | Kramm | 432/80 |
| 3,986,821 | | 10/1976 | MacNitt, Jr. | 432/112 |
| 4,056,363 | | 11/1977 | Messner | 23/270 R |
| 4,127,388 | | 11/1978 | Maczko et al. | 422/258 |
| 4,212,114 | * | 7/1980 | Wentzel | 34/167 |
| 4,286,946 | | 9/1981 | Christini | 432/112 |
| 4,389,794 | | 6/1983 | Bitterly | 34/5 |
| 4,400,153 | | 8/1983 | Miskell | 432/103 |
| 4,421,020 | * | 12/1983 | Gross | 99/472 |
| 4,455,135 | | 6/1984 | Bitterly | 432/1 |
| 4,583,468 | | 4/1986 | Reed et al. | 110/246 |
| 4,629,421 | * | 12/1986 | Kreisberg et al. | 432/77 |
| 4,644,664 | | 2/1987 | Bradshaw | 34/10 |
| 4,724,780 | * | 2/1988 | Hoffert et al. | 110/263 |
| 4,837,423 | * | 6/1989 | Peterson et al. | 219/390 |
| 4,914,276 | * | 4/1990 | Blair | 219/390 |
| 4,916,831 | | 4/1990 | Yasumura et al. | 34/134 |
| 4,961,391 | * | 10/1990 | Mak et al. | 110/346 |

(List continued on next page.)

FOREIGN PATENT DOCUMENTS

| | | |
|---|---|---|
| 256598 | 8/1947 | (CH) . |
| 42 02 749 A1 | 5/1993 | (DE) . |
| 42 37 161 A1 | 5/1994 | (DE) . |
| 1353434 | 1/1964 | (FR) . |
| 2584484 | 1/1987 | (FR) . |

OTHER PUBLICATIONS

International Search Report for PCT/US99/13972 mailed Oct. 26, 1999.

*Primary Examiner*—Teresa Walberg
*Assistant Examiner*—Shawntina T Fuqua

(57) ABSTRACT

A rotating vacuum kiln and method for heat treating solid particulate material under vacuum conditions uses a rotating refractory metal cylindrical vessel with a cool inlet zone, hot intermediate zone, and cool exit zone, with a first series of inner radiation shields provided at the hot intermediate zone adjacent to the cool inlet zone and a second series of inner radiation shields provided at the hot intermediate zone adjacent the cool exit zone to protect those two zones from the high temperatures in the hot intermediate zone. Heat for the hot intermediate zone of the cylindrical vessel is provided indirectly by electrical resistance heaters that surround the vessel and outer radiation shields are provided about the heaters to direct heat to the cylindrical vessel.

6 Claims, 4 Drawing Sheets

U.S. PATENT DOCUMENTS

| | | | | |
|---|---|---|---|---|
| 4,973,245 | | 11/1990 | Monni | 432/77 |
| 4,984,587 | | 1/1991 | Neville | 131/305 |
| 4,988,289 | | 1/1991 | Coucher | 432/103 |
| 5,018,968 | | 5/1991 | Barreto | 432/116 |
| 5,057,009 | | 10/1991 | Nechvatal et al. | 432/14 |
| 5,100,314 | | 3/1992 | Rierson | 432/103 |
| 5,169,307 | | 12/1992 | Frye | 432/14 |
| 5,171,357 | * | 12/1992 | Aguirre et al. | 75/10.19 |
| 5,302,118 | | 4/1994 | Renegar et al. | 432/14 |
| 5,347,725 | | 9/1994 | Sato | 34/386 |
| 5,375,344 | | 12/1994 | Ruefli et al. | 34/269 |
| 5,382,002 | * | 1/1995 | Evans et al. | 266/205 |
| 5,393,225 | * | 2/1995 | Freiberger et al. | 432/103 |
| 5,580,242 | * | 12/1996 | Becker | 432/103 |
| 5,711,664 | * | 1/1998 | Jegou et al. | 432/116 |
| 5,806,204 | | 9/1998 | Hoffman et al. | 34/92 |

* cited by examiner

HIGH TEMPERATURE ROTATING VACUUM KILN AND METHOD FOR HEAT TREATING SOLID PARTICULATE MATERIAL UNDER A VACUUM

The present application is a divisional of prior U.S. patent application Ser. No. 09/100,970 filed Jun. 22, 1998, now U.S. Pat. No. 6,105,272.

BACKGROUND OF THE INVENTION

The present invention relates to a rotary vacuum kiln and method for the treatment of solid particulate material under conditions of high temperature and under a high vacuum.

Solid particulate material must, at times, be treated under a vacuum at high temperatures in order to provide a desired product. In the manufacture of tantalum powders, for example, for use in capacitors, at one or more steps in processing, the powder is heat-treated in a vacuum furnace. Such treatment may be used to drive off residual impurities and to provide a flowable powder. A present processing system involves placement of a stack of trays containing tantalum powder into a vacuum furnace and heating the entire tray assembly. After a comparatively short heat treatment, in such a batchwise treatment, the entire tray assembly is cooled and a small amount of air is admitted until a layer of tantalum oxide has formed on the powder particle surfaces to prevent pyrophoric combustion of the powder upon subsequent exposure to air. Such a treatment is time-and energy-consuming and requires expensive equipment. Also, the fixed bed geometry of the treatment results in material near the outside of the bed being heated sooner and hotter than the material in the middle of the bed or tray stack. Heat transfer is also slow. In addition, since the material on the outside of the bed is heated more than that on the inside, uneven sintering can occur. A non-uniform product can result with various portions of the charge having different physical properties from others. If the material on the inside is not sufficiently sintered, the resultant product is fragile and a large proportion of this material turns to a dust during subsequent handling of the product. Such dust or fines must be recycled for reprocessing.

It is an object of the present invention to provide an apparatus for high temperature treatment of solid particulate material, while under a vacuum, by the use of a rotating kiln that will provide a more heat-treated uniform product.

It is another object of the present invention to provide a method for the continuous high temperature treatment of solid particulate material, such as tantalum powder, while under a vacuum, using a rotating kiln so as to provide a more uniform heat treated product.

SUMMARY OF THE INVENTION

A rotating vacuum kiln has a rotatable refractory metal cylindrical vessel that includes a cool inlet zone, a hot intermediate zone, and a cool exit zone. A gaseous exhaust conduit extends through an end wall of the cylindrical vessel through the cool exit zone and to the hot intermediate zone. A first series of inner radiation shields are provided in the cylindrical vessel at the hot intermediate zone adjacent to the cool inlet zone, and a second series of inner radiation shields are provided at the hot intermediate zone adjacent to the cool exit zone.

A first vacuum housing encloses a feed chute that directs solid particulate material to the cool inlet zone of the cylindrical vessel while under vacuum, while a second vacuum housing encloses a discharge chute for discharging treated material from the cylindrical housing while also under vacuum. Solid particulate material is moved through the rotating refractory metal cylindrical vessel by the use of screw flights attached to the inner surface of the vessel wall or by tilting the cylindrical vessel to allow flow by gravity.

The hot intermediate zone of the cylindrical vessel is indirectly heated by electric resistance heating bands which are provided, spaced from and along the hot intermediate zone, while outer radiation shields surround the heating bands and the cylindrical vessel along the hot intermediate zone. The use of the heating bands, radiation shields, and first and second series of inner radiation shields, concentrate the heat in the hot intermediate zone of the cylindrical vessel and shield the cool inlet zone, cool exit zone, and associated mechanical equipment, such as drive equipment and support equipment, from the high temperatures of the hot intermediate zone.

A method of heating a solid particulate material to high temperatures includes providing a rotating refractory metal cylindrical vessel having a cool inlet zone, hot intermediate zone and cool exit zone, with a first series of inner radiation shields at the hot intermediate zone adjacent the cool inlet zone and a second series of inner radiation shields at the hot intermediate zone adjacent the cool exit zone. Solid particulate material is moved through the rotating refractory metal cylindrical vessel while under a vacuum from the cool inlet zone and heated to a temperature of between about 1000° to 1700° C. in the hot intermediate zone and then discharged from the cool exit zone of the rotating refractory metal cylindrical vessel.

BRIEF DESCRIPTION OF THE DRAWINGS

The present invention will be more readily understood by reference to the following description of embodiments thereof and the accompanying drawings, wherein.

DETAILED DESCRIPTION

The rotating vacuum kiln of the present invention enables the heating of solid particulate material to a high temperature, for heat treatment or sintering under high vacuum conditions.

Figure 1:
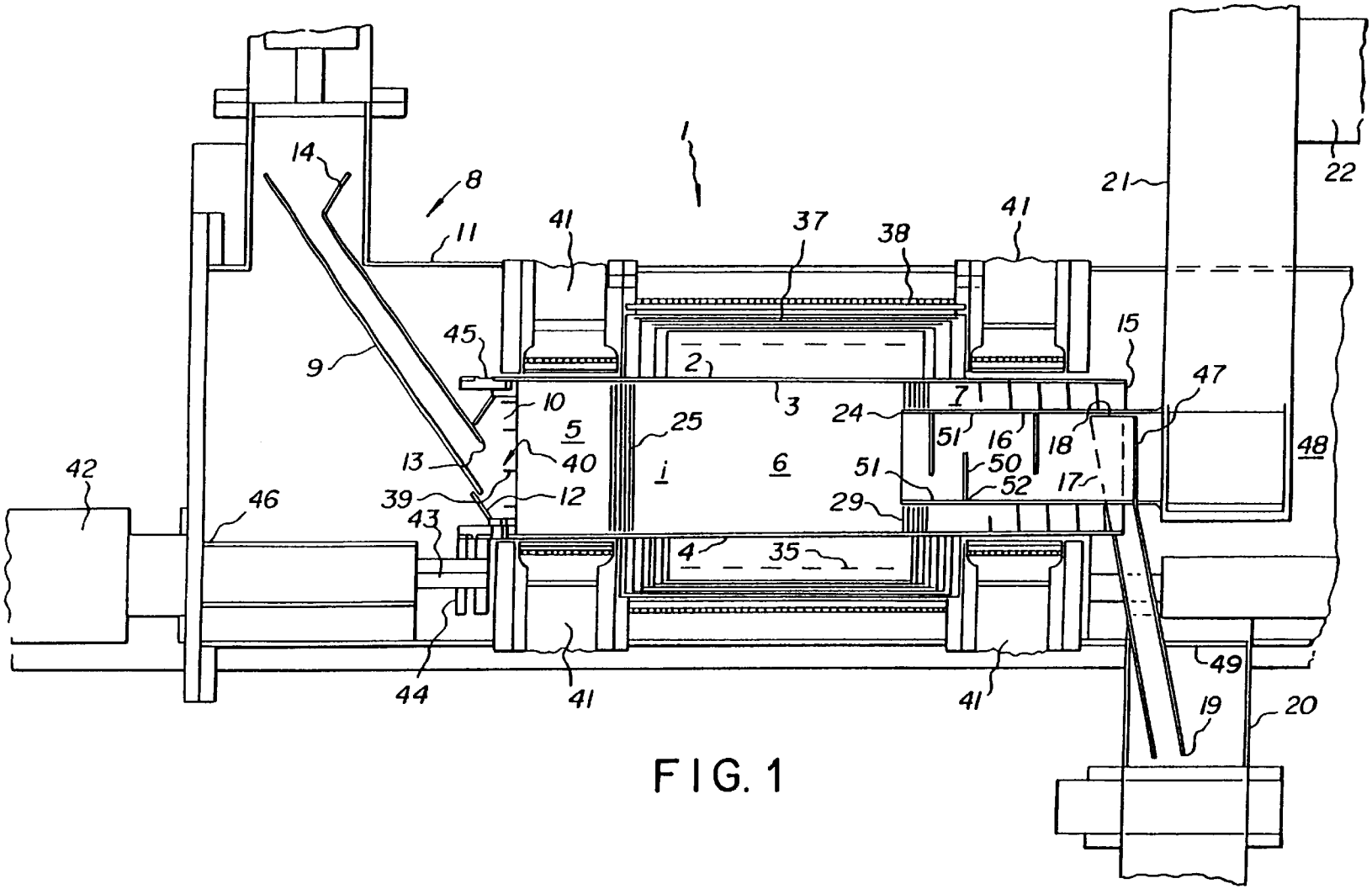
FIG. 1 is a longitudinal sectional view of a rotating refractory metal cylindrical vessel of the rotating vacuum kiln of the present invention.

Referring now to the drawings, FIG. 1 illustrates an embodiment of a rotary vacuum kiln 1 of the present invention having a rotating refractory metal cylindrical vessel 2 having an inner wall 3 and an outer wall 4, the rotating refractory metal cylindrical vessel 2 having a cool inlet zone 5, a hot intermediate zone 6, and a cool exit zone 7. A means 8 for charging a solid particulate material is provided on the cool inlet zone 5 of the cylindrical vessel 2, such as a feed chute 9, which feeds the material to a mixing and charging conduit 10 attached to the cylindrical vessel 2, that communicates with the cool inlet zone 5, the feed chute 9 and mixing and charging conduit 10 enclosed in a first vacuum housing 11. The mixing and charging conduit 10 includes an inclined wall 12 on the cylindrical vessel 2 that acts as a dam to prevent solid particulate material from escaping from the mixing and charging conduit 10 rather than moving towards the cool inlet zone 5 of the cylindrical vessel 2, which inclined wall 12 receives and encloses the discharge end 13 of the feed chute 9. Feed chute 9 also has an outwardly flared section 14 at the upper end to receive solid particulate material. The cool exit zone 7 of the cylindrical vessel 2 has an end wall 15 with a gaseous exhaust conduit 16 passing through the wall 15, and a discharge chute 17 communicating with the cylindrical vessel 2 at the cool exit zone 7, the discharge chute 17 having an open receiving end 18 within the cool exit zone 7 for receiving solid particulate material therefrom and a discharge end 19 for discharging solid particulate material therefrom. The discharge end 19 of discharge chute 17 is enclosed in a second vacuum housing 20.

Extending through the end wall 15 of the cylindrical vessel 2, the gaseous exhaust conduit 16 receives gases from the cylindrical vessel 2 and passes the same to a gaseous discharge conduit 21, while gaseous discharge conduit 21 is connected to a vacuum line 22 that is, in turn, connected to a vacuum pump 23. The gaseous exhaust conduit 16 is preferably concentric with an axis a of the cylindrical vessel 2, extends through the cool exit zone 7, and has an open end 24 disposed in the intermediate hot zone 6 of the cylindrical vessel 2.

Figure 2:
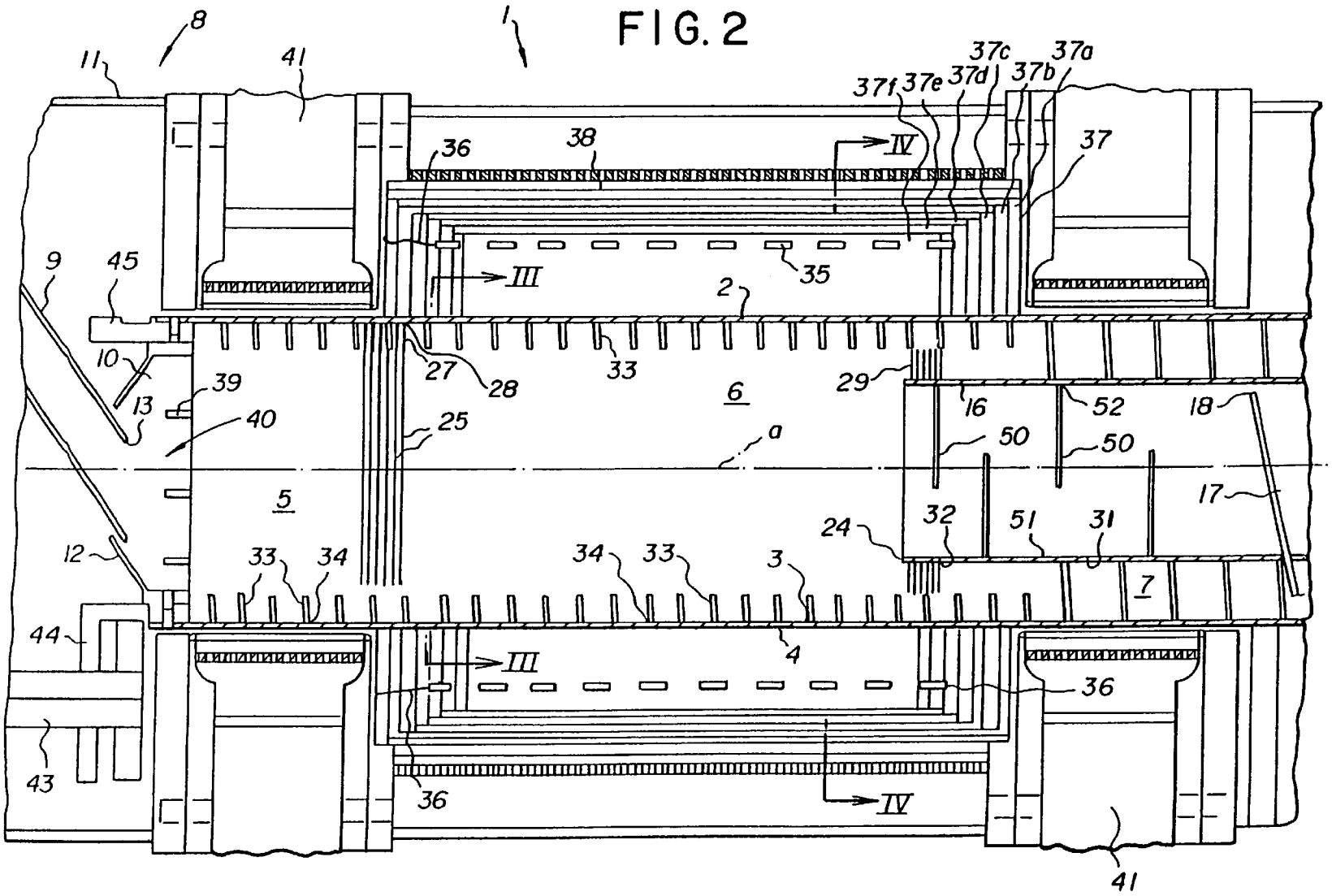
FIG. 2 is a longitudinal sectional view through another embodiment of a rotating vacuum kiln of the present invention.
Figure 4:
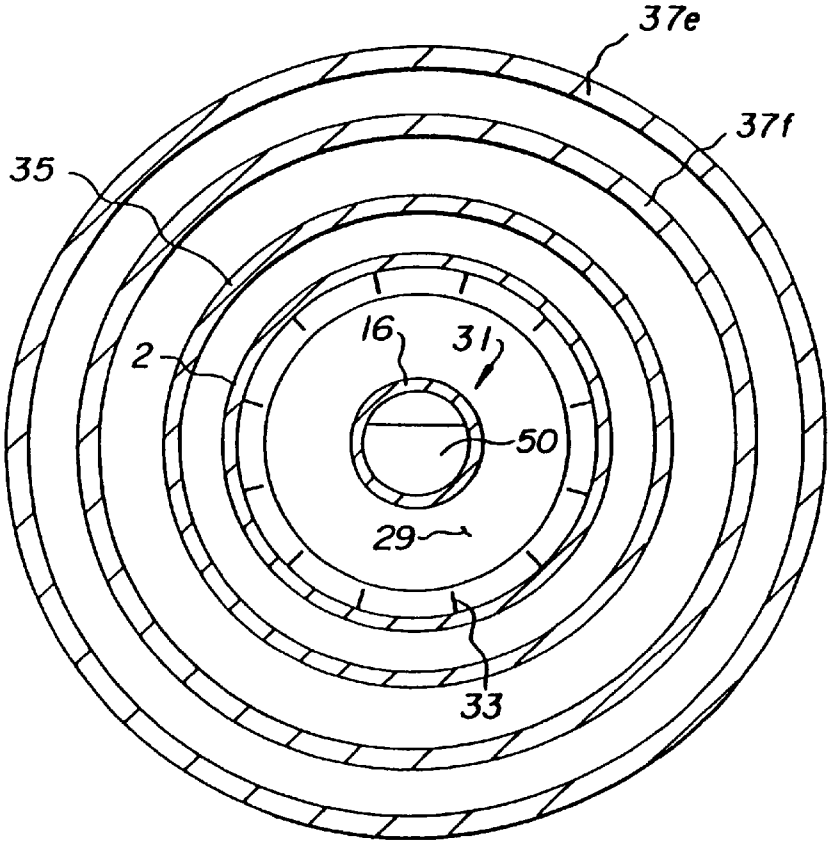
FIG. 4 is a view taken along lines IV—IV of FIG. 2.
Figure 3:
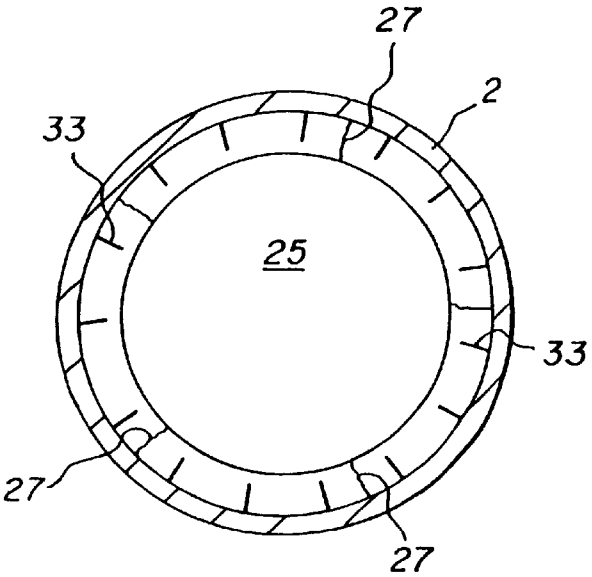
FIG. 3 is a view taken along lines III—III of FIG. 2.

A first series of inner radiation shields 25 is provided at the hot intermediate zone 6 adjacent to the cool inlet zone 5 of the cylindrical vessel 2 so as to reduce the flow of heat from the intermediate hot zone 6 to the cool inlet zone 5 of the cylindrical vessel 2. The first series of inner radiation shields 25 are secured to the inner wall 3, such as by spokes 27 that (FIG. 2) extend towards the inner wall and are welded, such as at 28 to the inner wall 3.

A second series of inner radiation shields 29 is provided in the hot intermediate zone 6 adjacent to the cool exit zone 7 of the cylindrical vessel 2 so as to reduce the flow of heat from the intermediate zone 6 to the cool exit zone 7. The second series of inner radiation shields 29 are secured to the outer wall 31 of the gaseous exhaust conduit 16, such as by welds 32. The second series of inner radiation 29 shields the cool exit zone 7 from the high temperatures of the intermediate hot zone 6 of the cylindrical vessel 2. A series of short screw flights 33 may be provided in the cool inlet zone 5, intermediate hot zone 6, and cool exit zone 7, secured to the inner wall 3 such as by welds 34, to move solid particulate material through the rotating refractory metal cylindrical vessel.

The intermediate hot zone 6 of the cylindrical vessel 2 is heated by use of an indirect heat source, such as electrical resistance heating bands 35 which are spaced from and encircle the outer wall 4 of the cylindrical vessel 2. The heating bands 35 extend along the length of the intermediate hot zone 6 and are energized through an electric current fed from a source (not shown) through electrical leads 36. In order to concentrate and direct the heat from the electrical resistance heating bands 35 towards the outer wall 4 of cylindrical vessel 2, at least one radiation shield 37 and preferably a series of radiation shields 37*a* to 37*f* (FIG. 2), are provided which are positioned concentrically about and spaced from the electrical resistance heating bands 35 and the intermediate hot zone 6 of the cylindrical vessel 2 and encircle and enclose the same. The radiation shields 37*a*–37*f* are enclosed within a shield housing 38.

The cool inlet zone 5 of the cylindrical vessel 2 may be provided with the series of short cool inlet zone screw flights 33 which are secured to the inner wall 3, such as by welds 34, and which extend from the inner wall 3 and will serve to move solid particulate material from the mixing and charging conduit 10 to the intermediate hot zone while a plurality of inwardly directed mixing flanges 39 may be provided on the inner wall 40 of the mixing and charging conduit 10 to mix solid particulate material fed thereto and charge the same to the cool short inlet zone screw flights 33.

Because the intermediate hot zone 6 of the cylindrical vessel 2, heating bands 35 and radiation shields 37 are contained in shield housing 38 and the first series of inner radiation shields 25 and second series of inner radiation shields 29 retain the heat within the intermediate hot zone, water cooled spool sections 41 may be used to enclose outer wall 4 of the cool inlet zone 5 and cool exit zone 7, and the spool sections may be made of less expensive ferrous alloys rather than a refractory metal as is required for the cylindrical vessel 2. The cylindrical vessel 2 may be rotated such as by use of a motor 42, having a shaft 43 with gears 44 that engage with a ring gear 45 carried by the cylindrical vessel 2, with the gears 44 contained within first vacuum housing 11 and shaft 43 passing through a seal 46 secured in a wall of the housing 11.

The end wall 15 of the cylindrical vessel 2 and the outer end 47 of the gaseous exhaust conduit 16 are also enclosed in a third vacuum housing 48, with discharge chute 19 passing through the lower wall 49 of third vacuum housing 48 into the second vacuum housing 20. The gaseous exhaust conduit 16 preferably has a plurality of baffles 50 connected to the inner wall 51, such as by welds 52 which are offset and spaced from each other along the horizontal axis a so as to provide a tortious path for gases flowing therethrough.

Figure 5:
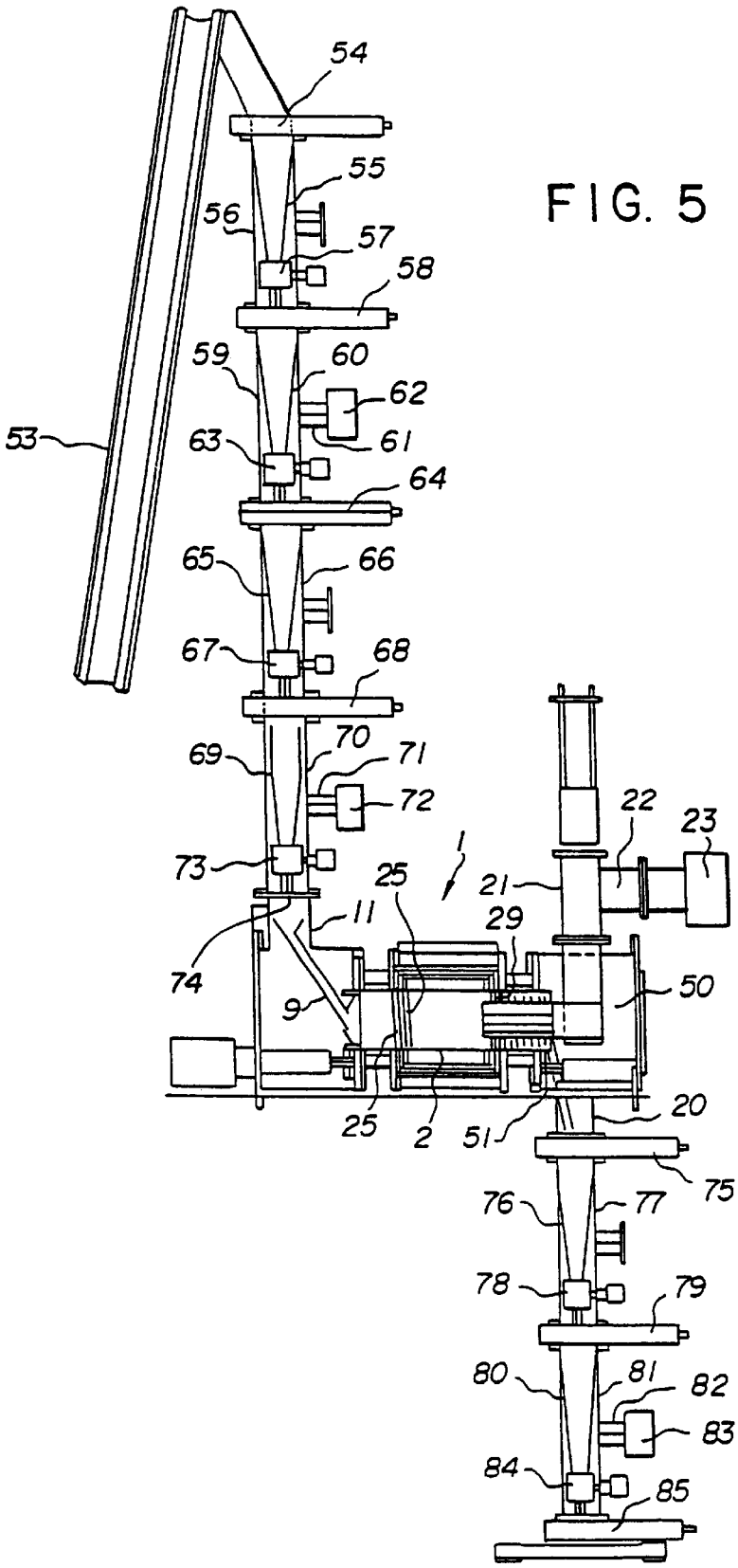
FIG. 5 is a schematic view of the rotating vacuum kiln of FIG. 1 illustrating the systems for feeding and discharging material under vacuum.

In order to maintain the interior i of the cylindrical vessel 2 under vacuum, while treating solid particulate material therein, the source of vacuum, vacuum pump 23 pulls a vacuum through vacuum line 22, gaseous discharge conduit 21, gaseous exhaust conduit 16, the interior i of cylindrical vessel 2, second vacuum housing 20 and first vacuum housing 11, with seals and bearings provided where necessary to keep leakage within acceptable limits, as is known to one skilled in the art. To assist in maintaining the vacuum within the system, and particularly within the interior i of the cylindrical vessel 2, a series of sealable feed hoppers and sealable discharge hoppers are provided, as shown in FIG. 5. As schematically illustrated, for charging the cylindrical vessel 2, solid particulate material to be treated is fed through a feed line 53, through a sealable inlet valve 54, to an initial feed chute 55, contained within a first feed housing 56 having a feeder 57 which cooperates with a second sealable valve 58. Second sealable valve 58 feeds to a second feed chute 59 which is contained within a first roughing vacuum feed housing 60 that is connected through line 61 to a source of vacuum, such as pump 62, and which has a feeder 63 which cooperates with a third sealable valve 64. Third sealable valve 64 feeds to an intermediate transfer feed chute 65 contained in an intermediate feed housing 66 that has an intermediate feeder 67 which cooperates with a fourth sealable valve 68. Fourth sealable valve 68 feeds to a further feed chute 69 which is contained within a housing 70 that is connected through line 71 to a source of vacuum, such as pump 72, and which has a feeder 73 which cooperates with a sealable valve 74 which cooperates with the first vacuum housing 11 so as to feed solid particulate material therefrom through outwardly flared section 14 to feed chute 9 and then to the cool inlet zone 5 of the cylindrical vessel 2. For discharging treated solid particulate material from the cylindrical vessel 2, the treated material is fed by the rotating refractory metal cylindrical vessel 2 into the open end 18 of discharge chute 17 into second vacuum housing 20, and through a first sealable discharge valve 75 into intermediate discharge chute 76 contained in a housing 77 that has an intermediate discharge feeder 78 which cooperates with a second sealable discharge valve 79. Second sealable discharge valve 79 feeds to a second discharge chute 80 which is contained in roughing discharge housing 81 that has a discharge line 82 for reducing the vacuum in the roughing discharge housing 81 through reduction valve 83, and which has a discharge feeder 84 which cooperates with final discharge sealable valve 85 to discharge the material from the system.

The operation of the rotating vacuum kiln 1 of the present invention is as follows. With motor 42 activated, the cylindrical vessel 2 is rotated by means of gears 44 meshing with gear ring 45 and upon activation of the vacuum pump 23, the system including vacuum line 22, gaseous discharge conduit 21, interior of housing 50, gaseous exhaust conduit 16, discharge chute 17, interior of second discharge housing 20, the interior i of cylindrical vessel 2, mixing and charging conduit 10, and the interior of first vacuum housing 11 are placed under a vacuum as is desired for a particular treatment. The electrical resistance heating bands 35 are activated to heat the hot intermediate zone 6 of the cylindrical vessel 2 to the desired temperature, with radiation shields 37 retaining such heating. At this stage, solid particulate material to be treated is provided in further feed chute 69, with the interior of housing 70, with sealable valves 68 and 74 closed, subjected to a vacuum comparable to that within the cylindrical vessel 2, by means of vacuum pump 72. Upon opening of sealable valve 74, solid particulate material is fed by feeder 73 to the feed chute 9 through outwardly flared section 14 and passes by gravity through the feed chute 9 to the mixing and charging conduit 10. In mixing and charging conduit 10, which is connected to, and rotating with, the cylindrical vessel 2, the solid particulate matter is mixed, by contact with and tumbling by flanges 39 on inner wall 40, while the inclined wall 12 prevents material escaping and urges the material into the cool inlet zone 5 of the cylindrical vessel 2. The solid particulate material in cool inlet zone 5 is moved by the short cool inlet zone screw flights 33 to, and through, the hot intermediate zone 6, while heating the material to the desired temperature. The hot material is then transferred, by short intermediate hot zone screw flights 33, towards the open receiving end 18 of discharge chute 17, with the hot material then fed through discharge chute 17 to housing 20 for discharge from the system. During the operation of the rotating vacuum kiln 1, the first series of inner radiation shields 25 shields the cool inlet zone 5 from the high temperature of the hot intermediate zone 6, while the second series of inner radiation shields 29 shields the cool exit zone 7 from that high temperature.

The present invention uses the above described rotating refractory metal cylindrical vessel 2 in heat-treating of solid particulate material. Solid particulate material is charged, under vacuum, to the cool inlet zone 5 of the rotating refractory metal cylindrical vessel 2. which has a cool inlet zone 5, hot intermediate zone 6 and cool exit zone 7, and a first series of inner radiation shields 25 at the hot intermediate zone 6 adjacent to the cool inlet zone 5, and a second series of inner radiation shields 29 at the hot intermediate zone 6 adjacent to the cool exit zone 7. The solid particulate material is moved through the rotating refractory metal cylindrical vessel 2 while under a vacuum and heated in the hot intermediate zone 6 to a temperature of between about 1000° to 1700° C. in the hot intermediate zone 6 and then discharged from the cool exit zone 7.

The heat treatment of solid particulate material according to the present invention is carried out under vacuum conditions and can be carried out at a vacuum below about 0.001 Torr and as low as of about $10^{-4}$ Torr or lower, with residence times in the hot intermediate zone 6 of between about 0.3 to 2.0 hours. With the use of the first and second series of radiation shields 25 and 29. with temperatures of between about 1000°–1700° C. preferably 1400°–1600° C. in the hot intermediate zone 6. the temperatures in the cool inlet zone 5 and the cool exit zone 7 would be about 300° C. or below.

When heat-treating of tantalum powder, for example, temperatures in the 1500° C. range would be required in the hot intermediate zone 6 and the rotating refractory metal cylindrical vessel 2 would be composed of a refractory metal, such as molybdenum, tantalum, tungsten, or a refractory metal alloy such as a molybdenum alloy containing minor amounts of titanium and zirconium. The term refractory metal, as used herein, is used to designate a metal which will last for sufficient periods of time at temperatures in range of up to about 1700° C. without deleterious effects. Where tantalum is to be treated, for example, the cylindrical vessel 2 could be formed from a molybdenum alloy containing minor amounts of titanium and zirconium, with an inner liner of tantalum which would contact the hot solid particulate material being treated though the cylindrical vessel 2. and with tantalum screw flights 33 welded to the inner liner on the wall 3 of the cylindrical vessel 2 and stitch-welded to each other so as to avoid differential expansion problems. A preferred embodiment would be "TEM", which is an alloy of molybdenum with about 0.5% titanium and 0.08% zirconium. A preferred liner material is tantalum when processing tantalum powder.

The residence time in the cylindrical vessel 2 can be adjusted as desired by the pitch. height and cylindrical vessel rotation speed. In some instances. as shown in FIG. 1. the use of screw flights 33 may be avoided if the cylindrical vessel 2 is positioned at a downward angle from the cool inlet zone 5 to the cool exit zone 7 and the material allowed to assume its natural angle of rill under rotation, and the material will move the same through the cylindrical vessel 2.

Feeding of the cylindrical vessel 2 is carried out by feeding solid particulate material through feed line 53 and through open valve 54 into initial feed hopper or chute 55 at atmospheric pressure. Valve 54 is then closed and the material transferred by feeder 57 through opened valve 58 into second feed chute 59. With valve 58 and valve 64 in closed position, a partial vacuum is provided in housing 60 through line 61 by activation of vacuum pump 62. When the desired partial vacuum is achieved, valve 64 is opened and feeder 63 feeds the material to intermediate transfer feed chute 65. Valve 64 is then closed and valve 68 opened, and the material, under partial vacuum, is fed by intermediate feeder 67 into further feed chute 69. With valves and with vacuum pump 72 activated, a vacuum that approaches the high vacuum desired in the cylindrical vessel 2 is applied and feeder 73 used to discharge the material to feed chute 9 through flared section 14. In the heat-treating of tantalum powder, a vacuum in the refractory metal cylindrical vessel 2 of about 0.001 Torr or below would be provided. In discharge of treated material from the cylindrical vessel 2, a reverse procedure is carried out, where treated solids from the cylindrical vessel 2 are discharged therefrom through discharge chute 76 into second vacuum housing 20. With second discharge valve 79 closed, the first discharge valve 75 is opened and the material fed to intermediate discharge chute 76. First discharge valve 75 is then closed and second discharge valve 79 opened as that material is fed by intermediate discharge feeder 78 into second discharge chute 80. With final discharge valve 85 in closed position, second discharge valve 79 is then closed and vacuum released through line 82 and reduction valve 83. The material may be discharged into a further rotating drum (not shown) at atmospheric pressure where cooling and passivation would be effected. With the vacuum released, and a small amount of air injected to form an oxidized coating on the material, final discharge valve 85 may then be opened and the treated material removed for use.

What is claimed is:

1. A method of heating a solid particulate material to a temperature of 1000° to 1700° C. under a vacuum comprising:

producing a rotating refractory metal cylindrical vessel having inner and outer walls, a cool inlet zone, a hot intermediate zone, and a cool exit zone, a first series of inner radiation shields at said hot intermediate zone adjacent said cool inlet zone and a second series of inner radiation shields at said hot intermediate zone adjacent said cool exit zone, moving solid particulate matter through said rotating refractory metal cylindrical vessel while under a vacuum;

heating said solid particulate metal to a temperature of 1000° to 1700° C. in said hot intermediate zone; and discharging said heated solid particulate material from said cool exit zone.

2. The method as defined in claim 1 wherein said vacuum is at 0.001 Ton or below.

3. The method as defined in claim 1 wherein said solid particulate material is tantalum powder.

4. The method as defined in claim 3 wherein said vacuum is at 0.001 ton or below.

5. The method as defined in claim 3 wherein the residence time of said tantalum powder in the hot intermediate zone is between about 0.3 to 2.0 hours.

6. The method as defined in claim 3 wherein said temperature is between about 1400° to 1600° C.

* * * * *

UNITED STATES PATENT AND TRADEMARK OFFICE

CERTIFICATE OF CORRECTION

PATENT NO. : 6,271,501 B1
APPLICATION NO. : 09/611828
DATED : August 7, 2001
INVENTOR(S) : Allan C. Morgan It is certified that error appears in the above-identified patent and that said Letters Patent is hereby corrected as shown below:

At column 8, line 1, change “matter” to --material--.

At column 8, line 5, change “metal” to --material--.

At column 8, line 10, change “Ton” to --torr--.

At column 8, line 15, change “ton” to --torr--.

Signed and Sealed this

Sixth Day of January, 2009

JON W. DUDAS
*Director of the United States Patent and Trademark Office*